US012097442B2

(12) United States Patent
Schlapik et al.

(10) Patent No.: US 12,097,442 B2
(45) Date of Patent: Sep. 24, 2024

(54) PENTAHEDRAL MODULE PUZZLE

(71) Applicant: Kevin D. Schlapik, Dania Beach, FL (US)

(72) Inventors: Kevin D. Schlapik, Fort Lauderdale, FL (US); Yu Sheng, Guandong (CN)

(73) Assignee: Kevin Schlapik, Dania Beach, FL (US)

( * ) Notice: Subject to any disclaimer, the term of this patent is extended or adjusted under 35 U.S.C. 154(b) by 0 days.

(21) Appl. No.: 18/349,260

(22) Filed: Jul. 10, 2023

(65) Prior Publication Data

US 2023/0347234 A1 Nov. 2, 2023

Related U.S. Application Data

(63) Continuation of application No. PCT/US2022/051484, filed on Dec. 1, 2022.

(60) Provisional application No. 63/285,049, filed on Dec. 1, 2021.

(51) Int. Cl.
*A63F 9/08* (2006.01)

(52) U.S. Cl.
CPC ..... *A63F 9/088* (2013.01)

(58) Field of Classification Search
CPC ..... A63F 9/088; A63H 33/046
See application file for complete search history.

(56) References Cited

U.S. PATENT DOCUMENTS

| | | | |
|---|---|---|---|
| 1,997,022 | A | 4/1935 | Stalker |
| 2,570,625 | A | 10/1951 | Zimmerman et al. |
| 2,839,841 | A | 6/1958 | Berry |
| 2,992,829 | A | 7/1961 | Hopkins |
| 3,254,440 | A | 6/1966 | Duggar |
| 3,618,954 | A | 11/1971 | Murff |
| 3,645,535 | A | 2/1972 | Randolph |
| 3,659,360 | A | 5/1972 | Zeischegg |
| 3,662,486 | A | 5/1972 | Freedman |
| 3,746,345 | A | 7/1973 | Palazzolo |
| 3,831,503 | A | 8/1974 | Tranquillitsky |
| 3,916,559 | A | 11/1975 | Flowerday |
| 4,020,205 | A | 4/1977 | Haselbauer |
| D246,544 | S | 11/1977 | Brinkley |
| 4,063,725 | A | 12/1977 | Snyder |
| D248,987 | S | 8/1978 | Paschal |
| 4,142,321 | A | 3/1979 | Coppa |
| 4,227,334 | A | 10/1980 | Hooker |

(Continued)

FOREIGN PATENT DOCUMENTS

| | | | | |
|---|---|---|---|---|
| CN | 108371823 A | * | 8/2018 | ..... A63H 33/046 |
| DE | 4200184 A1 | | 8/1992 | |

(Continued)

OTHER PUBLICATIONS

English machine translation of WO-9211911-A1 (Pfeffer) (Year: 1992).*

(Continued)

*Primary Examiner* — Steven B Wong
(74) *Attorney, Agent, or Firm* — IPkey PLLC; John W. Zerr; Kyle E. Yarberry

(57) ABSTRACT

Pentahedral module puzzles include a plurality of pentahedral modules connected by hinges in a continuous loop. Each pentahedral module comprises at least one magnet. The pentahedral modules include mirror image pentahedral modules connected by the hinges in an alternating sequence.

20 Claims, 9 Drawing Sheets

(56) References Cited

U.S. PATENT DOCUMENTS

| | | | |
|---|---|---|---|
| 4,258,479 | A | 3/1981 | Roane |
| D264,361 | S | 5/1982 | Meffert |
| 4,334,870 | A | 6/1982 | Roane |
| 4,334,871 | A | 6/1982 | Roane |
| 4,377,916 | A | 3/1983 | Komiya |
| 4,392,323 | A | 7/1983 | Rubik |
| 4,484,406 | A | 11/1984 | Matsumoto et al. |
| 4,722,712 | A | 2/1988 | Mckenna |
| 4,886,273 | A | 12/1989 | Unger |
| 4,993,989 | A | 2/1991 | Gidwani |
| 5,009,625 | A | 4/1991 | Longuet-Higgins |
| D321,671 | S | 11/1991 | Goonen |
| D324,891 | S | 3/1992 | Vershaeve, Jr. et al. |
| 5,108,100 | A | 4/1992 | Essebaggers et al. |
| 5,192,077 | A | 3/1993 | Caicedo |
| 5,193,809 | A | 3/1993 | Hrsel et al. |
| 5,199,711 | A | 4/1993 | Pataki et al. |
| 5,249,966 | A | 10/1993 | Hiigli |
| 5,299,804 | A | 4/1994 | Stevens |
| 5,322,284 | A | 6/1994 | El-Agamawi |
| 5,338,034 | A | 8/1994 | Asch |
| D365,295 | S | 12/1995 | Kandampully |
| 5,630,587 | A | 5/1997 | Zlotsky |
| 5,651,715 | A | 7/1997 | Shedelbower |
| 5,660,387 | A | 8/1997 | Stokes |
| 5,746,638 | A | 5/1998 | Shiraishi |
| 5,762,529 | A | 6/1998 | Nizza |
| 6,017,220 | A | 1/2000 | Snelson |
| 6,024,626 | A | 2/2000 | Mendelsohn |
| 6,196,544 | B1 | 3/2001 | Rachofsky |
| 6,257,574 | B1 | 7/2001 | Evans |
| 6,264,199 | B1 | 7/2001 | Schaedel |
| 6,386,541 | B1 | 5/2002 | Cornelius et al. |
| 6,467,205 | B1 | 10/2002 | Flagg et al. |
| D475,094 | S | 5/2003 | Ko |
| 6,796,560 | B1 | 9/2004 | Cornelius et al. |
| D617,850 | S | 6/2010 | Langin-Hooper |
| 8,061,713 | B2 | 11/2011 | Cook |
| 8,087,671 | B2 | 1/2012 | Houlis |
| 8,157,608 | B1 | 4/2012 | Stapleton |
| 9,662,592 | B2 | 5/2017 | Haughey et al. |
| 10,569,185 | B2 | 2/2020 | Hoenigschmid |
| 10,918,964 | B2 | 2/2021 | Hoenigschmid |
| 11,358,070 | B2 * | 6/2022 | Åberg ..... A63H 33/086 |
| 2007/0037469 | A1 | 2/2007 | Yoon |
| 2008/0224665 | A1 | 9/2008 | Matsumoto et al. |
| 2008/0274665 | A1 | 11/2008 | Cheng |
| 2010/0038850 | A1 | 2/2010 | Tenorio |
| 2010/0087119 | A1 | 4/2010 | Vicentelli |
| 2010/0120322 | A1 | 5/2010 | Vicentelli |
| 2010/0225057 | A1 | 9/2010 | Akiyama et al. |
| 2012/0164913 | A1 | 6/2012 | Pomeroy et al. |
| 2014/0213139 | A1 | 7/2014 | Ferguson et al. |
| 2014/0357151 | A1 | 12/2014 | Worley |
| 2015/0065007 | A1 | 3/2015 | Klepper et al. |
| 2016/0199749 | A1 | 7/2016 | Whittaker |
| 2022/0047960 | A1 | 2/2022 | Hoenigschmid |

FOREIGN PATENT DOCUMENTS

| | | | | |
|---|---|---|---|---|
| DE | 19617526 | A1 | 5/1997 | |
| DE | 202014002837 | U | 6/2014 | |
| DE | 202014002837 | U1 * | 7/2014 | ..... A63F 9/088 |
| FR | 1582965 | A | 10/1969 | |
| FR | 2669550 | A1 | 5/1992 | |
| GB | 588842 | A | 6/1947 | |
| GB | 2064844 | A | 6/1981 | |
| GB | 2074459 | A * | 11/1981 | ..... A63F 9/088 |
| GB | 2107200 | A | 4/1983 | |
| KR | 200454067 | * | 6/2011 | ..... A63F 9/10 |
| KR | 200454067 | Y1 | 6/2011 | |
| WO | WO-9211911 | A1 * | 7/1992 | ..... A63F 9/088 |
| WO | 2013097872 | A1 | 7/2013 | |
| WO | 2014038735 | A1 | 3/2014 | |
| WO | 2015141927 | A1 | 9/2015 | |
| WO | WO-2022130285 | A1 * | 6/2022 | ..... A63F 9/088 |

OTHER PUBLICATIONS

English machine translation of CN-108371823-A (Chen) (Year: 2018).*

International Search Report and Written Opinion mailed on Apr. 6, 2023, issued in corresponding International Application No. PCT/US2022/51484, filed Dec. 1, 2022, 12 pages.

* cited by examiner

PENTAHEDRAL MODULE PUZZLE

CROSS-REFERENCE TO RELATED APPLICATIONS

This application is a continuation of International Patent Application No. PCT/US22/51484, filed Dec. 1, 2022, which claims the benefit of U.S. Provisional Patent Application No. 63/285,049, filed Dec. 1, 2021, the entirety of which are expressly incorporated by reference.

TECHNICAL FIELD

The present disclosure relates to the field of toys and puzzles.

BACKGROUND

Puzzles have enjoyed cross-generational appeal as games, toys, teaching aids, therapy devices, and the like. Such puzzles may be configured between different geometric configurations as shown in, e.g., UK Patent Application No. GB 2,107,200 to Asano and U.S. Pat. No. 6,264,199 B1 to Schaedel. As taught in the prior art, the properties of any particular polyhedral puzzle are highly specific to the geometry and hinging arrangements of that specific puzzle. For example, the folding puzzle taught in Schaedel teaches a folding puzzle consisting of twenty-four identical isosceles tetrahedron bodies, each being formed of four triangular faces having angles of approximately 70.53°, 54.74°, and 54.74°. The tetrahedrons are joined to each other at their base (longest) edges and can be manipulated into a rhombic dodecahedron in "many different ways." However, Schaedel does not teach any other geometry capable of achieving a rhombic dodecahedron in many different ways. Indeed, as one skilled in the art will appreciate, there are seemingly infinite different combinations of variables in such a puzzle, including: the number of faces and edges of the polyhedra, the interior angles and edge lengths of the polyhedra, the number of polyhedra, whether all polyhedra are identical or not, how the polyhedra are ordered, the location of the hinges between the polyhedra, and other variables. Moreover, due to such seemingly infinite combinations of variables and the unpredictable interrelation between changes in variables, even minor variations of one variable can alter the properties of the overall puzzle, often in ways that are detrimental to the functionality of the puzzle itself.

Accordingly, there is a need for new puzzles having different geometries and exciting new properties.

BRIEF SUMMARY

In an aspect, the present disclosure provides pentahedral module puzzles comprising a plurality (e.g., sixteen) pentahedral modules connected by a plurality of hinges in a continuous loop, wherein each pentahedral module comprises at least one magnet (e.g., a plurality of magnets).

In another aspect, the present disclosure provides pentahedral module puzzles, comprising a plurality of pentahedral modules connected by a plurality of hinges in a continuous loop, wherein each pentahedral module comprises at least one magnet, wherein each of the plurality of pentahedral modules has two isosceles triangle faces and wherein sequential hinges of the plurality of hinges have a perpendicular orientation, such that the plurality of pentahedral modules can be manipulated into different multiples of geometrically similar shapes.

In any embodiment, the plurality of pentahedral modules may comprise mirror image pentahedral modules connected by the hinges in an alternating sequence, wherein the plurality of magnets of each pentahedral module has a different polarity from the plurality of magnets of each adjacent pentahedral module in the alternating sequence.

In any embodiment, sequential hinges of the plurality of hinges may have a perpendicular orientation.

In any embodiment, each pentahedral module comprises two isosceles triangle faces, e.g., right isosceles triangle faces.

In any embodiment, each pentahedral module may comprise one, two, three, four, or more magnets, each of the magnets being disposed adjacent to a different face of the pentahedral module.

In any embodiment, each of the pentahedral modules may comprise a shell and a cover enclosing a cavity, wherein a first groove is formed in a first interior surface the cavity, the first groove being at least partially delimited by a stop block and receiving a first magnet therein.

In any embodiment, each of the pentahedral modules may comprise a first clamping block extending away from a second interior surface of the cavity, the first clamping block having a magnet abutting surface at a distal end thereof, wherein the magnet abutting surface is positioned adjacent to the first magnet.

In any embodiment, each of the pentahedral modules may comprise a second groove formed in a third interior surface of the cavity, the second groove being at least partially delimited by a holding portion extending away from the third interior surface and holding a second magnet of the plurality of magnets in the second groove.

In any embodiment, each of the pentahedral modules may comprises a second clamping block extending away from the second interior surface of the cavity, wherein the second clamping block extends into the second groove and holds the second magnet in the second groove.

In any embodiment, each of the pentahedral modules may comprise a third groove formed in a fourth interior surface of the cavity, the third groove being at least partially delimited by a second stop block and receiving a third magnet therein.

In any embodiment, each of the pentahedral modules may comprise a boss on the second interior surface of the cavity, wherein the boss comprises a fourth groove receiving a fourth magnet therein.

BRIEF DESCRIPTION OF THE SEVERAL VIEWS OF THE DRAWINGS

Representative embodiments are described with reference to the following figures, wherein alike reference numerals refer to alike parts throughout the various views unless otherwise specified.

DETAILED DESCRIPTION

The present disclosure provides pentahedral module puzzles (interchangeably referred to as "puzzles" herein) comprising hingedly connected polyhedral modules (e.g., pentahedral modules), each of which has particular geometric characteristics. Each pentahedral module is hingedly connected to two other pentahedral modules of the transformation and optionally has structural features which enable unique functionality and/or exhibit unique properties.

Figure 1A:
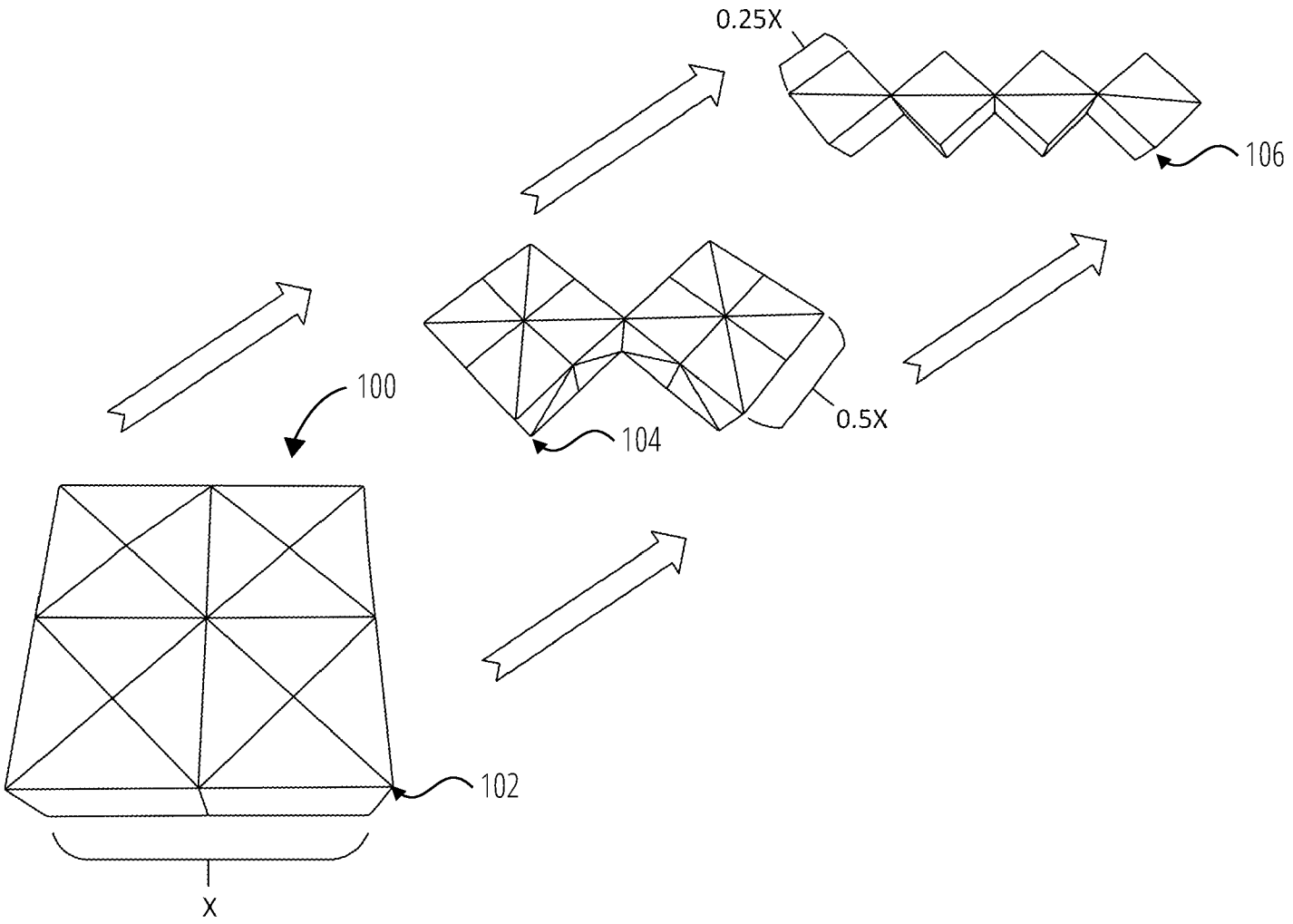
FIG. 1A shows perspective views of a pentahedral module puzzle in three different configurations at three different points in time, wherein each configuration comprises a different number of geometrically similar shapes, according to a representative embodiment of the present disclosure.

FIG. 1A shows one example of a pentahedral module puzzle 100 (hereafter referred to as a puzzle for brevity) according to a representative embodiment of the present disclosure. Before describing the details of the individual elements of the puzzle 100, the high-level features and properties will first be introduced.

As shown and described herein, the puzzle 100 includes a plurality of pentahedral modules which are flexibly connected by hinges in a continuous loop. This structure enables the puzzle 100 to be manipulated into numerous different configurations. In particular, FIG. 1A shows the same puzzle 100 in three different configurations at three different points in time. Unlike known puzzles, the puzzle 100 comprises pentahedral modules arranged in a particular sequence and having particular characteristics which yield exciting new properties.

One significant new property of the puzzle 100 is a "scaling" property, i.e., the ability to be manipulated into different multiples of geometrically similar shapes. This property results from the geometry of each module, the number of modules, and the placement of hinges therebetween. For example, in some embodiments, each of the modules has two isosceles triangle faces and wherein sequential hinges of the plurality of hinges have a perpendicular orientation, such that the pentahedral modules can be manipulated into different multiples of geometrically similar shapes.

For example, as shown in FIG. 1A, the puzzle 100 can be manipulated into a single rhombic hexahedron 102, a set of two hexahedrons 104, and a set of four hexahedrons 106, all of which are geometrically similar but different absolute edge lengths (in this case, they are congruent except for scale). That is, the hexahedron 102 has an edge length X, each of the two hexahedrons 104 has an edge length 0.5×, and each of the four hexahedrons 106 has an edge length 0.25×.

Not only is this "scaling" property novel and interesting, but it enables the puzzle 100 to be used as an aid to teach concepts such as logarithms, exponents, and volume. For example, if the single hexahedron 102 represents $2^0$, then the set of two hexahedrons 104 represents $2^1$ and the set of four hexahedrons 106 represents $2^2$. As another example, each of the hexahedron 102, set of two hexahedrons 104, and the set of four hexahedrons 106 have identical volumes (each being formed from a common set of space filling pentahedral modules). Further, the edges of each of the hexahedron 102, set of two hexahedrons 104, and the set of four hexahedrons 106 have the same perimeter.

Figure 1B:
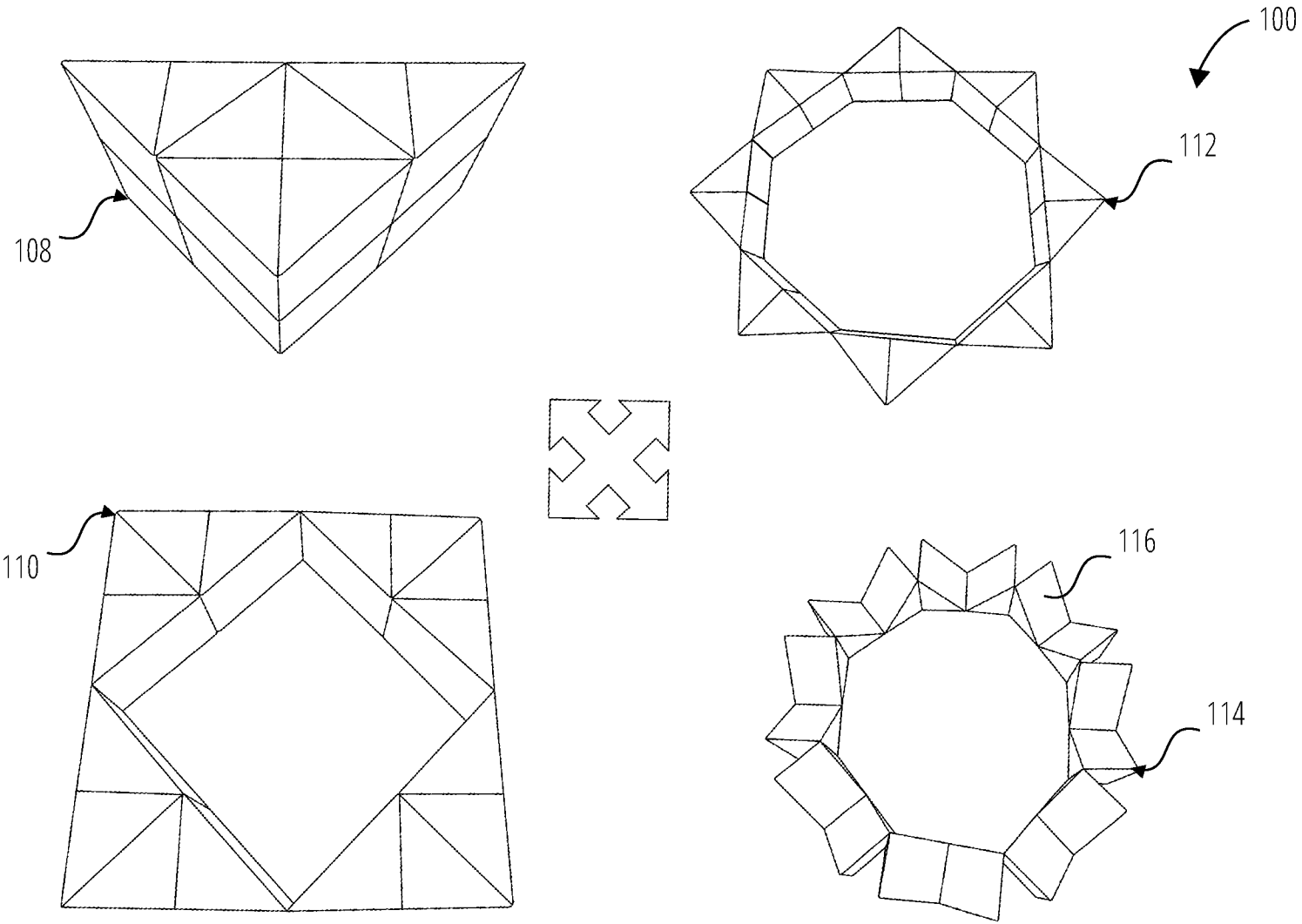
FIG. 1B shows perspective views of the pentahedral module puzzle of FIG. 1A in four different configurations at four different points in time, wherein each configuration comprises a different number of geometrically similar shapes.

To illustrate that the scaling property is not limited to rhombic hexahedrons, FIG. 1B shows the same puzzle 100 manipulated into scaling numbers of geometrically similar isosceles triangular pentahedrons. Specifically, the puzzle 100 may be manipulated into a single isosceles triangle pentahedron 108, a set of four pentahedrons 110, a set of eight pentahedrons 112, or a set of sixteen pentahedrons 114. Each of the pentahedrons 108, 110, 112, and 114 are geometrically similar (i.e., have the same edge length ratios). And, the single isosceles pentahedron 108, the set of four pentahedrons 110, the set of eight pentahedrons 112, and the set of sixteen pentahedrons 114 have a common volume and edge lengths with a common perimeter. The edge length ratio is established by the dimensions of the fundamental pentahedral module 116, i.e., each one of the sixteen pentahedrons 114. The details of said pentahedral modules are described below.

In some embodiments, each of the plurality of pentahedral modules has two isosceles triangle faces and wherein sequential hinges of the plurality of hinges have a perpendicular orientation, such that the plurality of pentahedral modules can be manipulated into different multiples of geometrically similar shapes.

Figure 2:
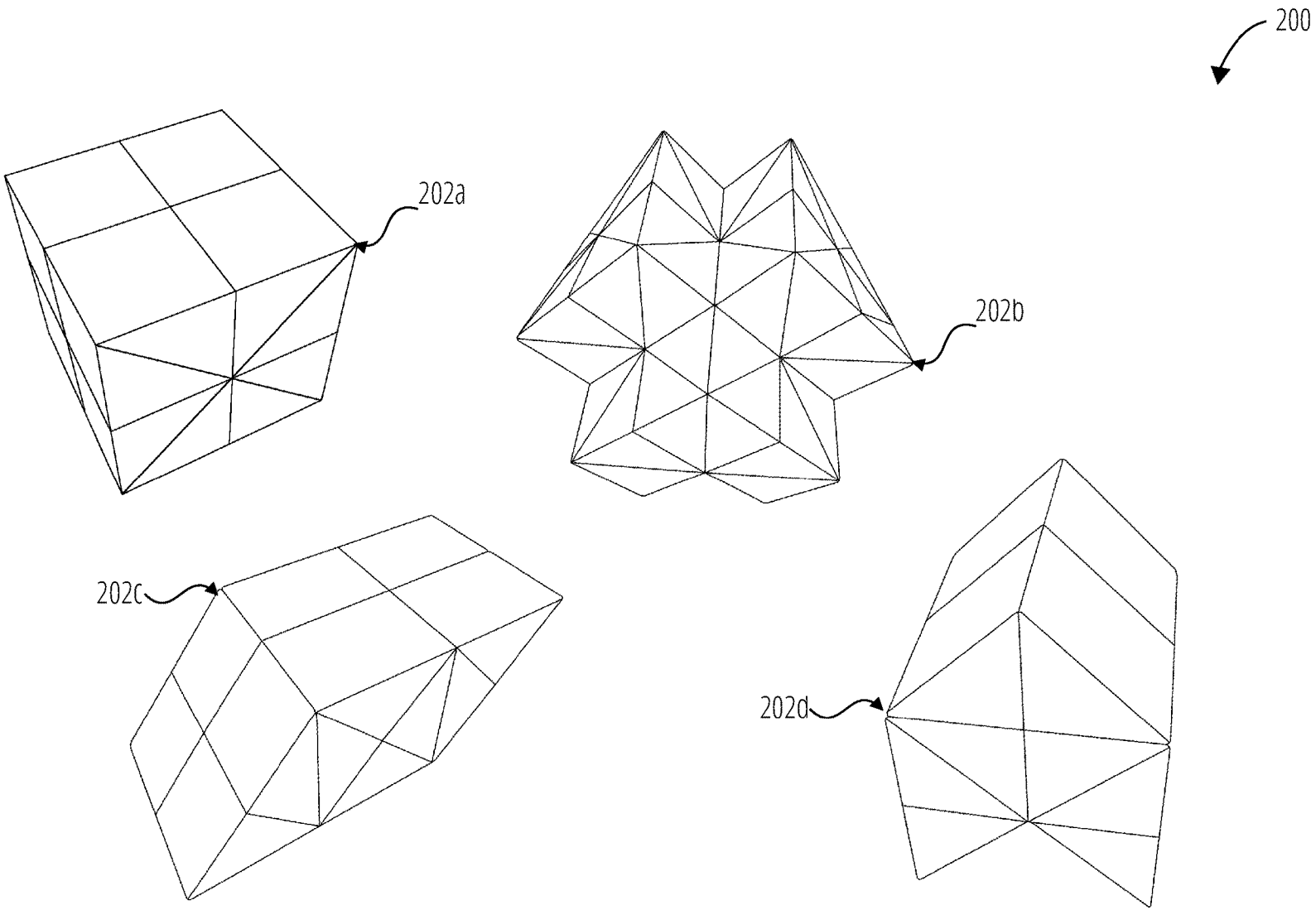
FIG. 2 shows perspective views of a pentahedral module puzzle in four different configurations at four different points in time, according to a representative embodiment of the present disclosure.

FIG. 2 shows another pentahedral module puzzle 200 which is identical to the puzzle 100 of FIG. 1A. As shown, another significant new property of the puzzle 200 is the ability for a user to manipulate its structure into a multitude of visually and tactically interesting space-filling shapes. A sampling of such shapes is shown in FIG. 2, including a cube 202*a*, as well as a trilobal polyhedron 202*b* wherein at least two of the lobes have isosceles triangle faces, a non-cubic rhombic prism 202*c*, and a concave hexagonal prism 202*d* (i.e., an arrow-shaped prism)—the latter three of which were heretofore not achievable with known puzzles.

Still another interesting new property is the ability of the puzzle 100 to achieve the cube 202*a* more than one different way. That is, the puzzle 100 can achieve the cube 202*a* in a first way in which the exterior faces of the cube 202*a* consist of certain faces of the underlying pentahedral modules, and in a second way in which the exterior faces of the cube 202*a* consist of at least some different faces of the underlying pentahedral modules.

The foregoing properties and configurations are merely representative of the advantages achieved by the specific geometry and arrangement of pentahedral modules of the puzzle 200, the details of which will now be described.

Figure 3:
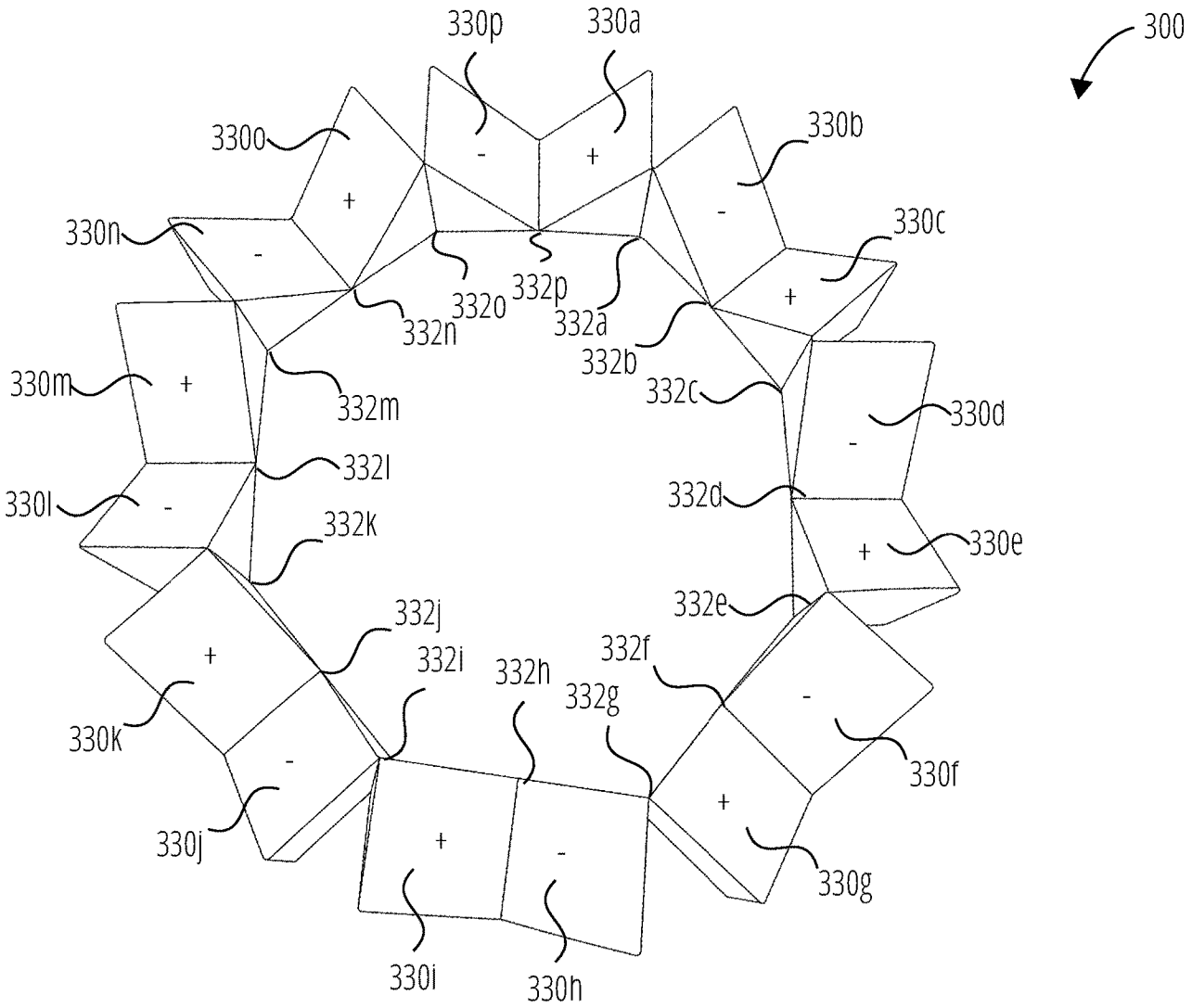
FIG. 3 shows an upper perspective view of the pentahedral module puzzle of FIG. 1A and FIG. 1B in another configuration.

FIG. 3 shows a puzzle 300 having the same construction as the puzzles 100, 200. The puzzle 300 is formed of a plurality of pentahedral modules 330*a-p* (hereinafter, modules). In the embodiment shown, the modules 330*a* are congruent pentahedrons and each has a geometry which is detailed in FIG. 4.

The representative puzzle 300 includes sixteen modules 330*a-p*, although other embodiments may include a greater number by splitting one or more of the modules 330*a-p* into sub-polyhedrons. For example, an embodiment may split each of the modules 330*a-p* into two separate, complementary polyhedrons which, when combined, have the same pentahedral shape as the individual modules 330*a-p*. Accordingly, such an embodiment would comprise 32 pentahedrons. In such fashion, the present disclosure also includes puzzles comprising 32, 48, or a greater number of pentahedrons which are a multiple of sixteen.

The modules 330*a-p* are hingedly connected by the hinges 332*a-p* in a continuous loop. Due to the geometry of each module (which is detailed in FIG. 4), sequential hinges have a perpendicular orientation relative to each other.

In particular, each of the modules 330*a-p* is hingedly connected to two adjacent of the modules 330*a-p* by two of the hinges 332*a-p*. For example, hinge 332*a* hingedly connects a first edge of module 330*a* to the corresponding first edge of mirror image module 330*b*. Similarly, hinge 332*b* hingedly connects a second edge of module 330*b* to the corresponding edge of mirror image 330*c*.

The hinges enable the pentahedral modules to be manipulated relative to each other such that the puzzle can achieve different configurations (such as the scaling configurations of FIG. 1A-FIG. 1B) as well as the configurations shown in FIG. 2 and additional configurations while the whole puzzle remains a singular apparatus, rather than an uncoordinated assortment of parts.

The pentahedral modules of the puzzles described herein are generally assembled such that the corresponding edges (immediately adjacent edges) of adjacent pentahedral modules abut or have a separation of less than 1 mm, e.g., 0.5 mm. This is evident from FIG. 3, which shows the puzzle 300 and its representative hinged connections between adjacent polyhedrons.

The hinges 332*a-p* may take many different forms. In some embodiments, such as shown in FIG. 3, each of the hinges 332*a-p* is a decal or sticker applied to the faces of at least two adjacent pentahedral modules (e.g., the mirror image faces of adjacent modules) such that the hinge extends from one of the modules directly to another module. For example, referring to FIG. 3, hinge 332*b* is a decal applied at least to module 330*a* and extending to the adjacent, mirror image face of module 330*b*, thus hingedly connecting the adjacent modules. In some such embodiments, the decal may comprise more than one hinge. For example, in an embodiment, a single continuous decal is applied to modules 330*a-p* and accordingly comprises at least hinges 332*a-p*. Representative hinges of this configuration are detailed in U.S. Pat. Nos. 10,569,185 and 10,918,964 to Hoenigschmid, which are herein incorporated by reference in their entireties.

In other embodiments, the hinges are formed integrally with the modules (e.g., living hinges) and extend directly from one of the modules to an adjacent module. In such embodiments, the hinges may be formed as a flexible polymer strip of a same or similar material as the outer shell of the module. For example, referring to FIG. 3, if hinge 332*b* had such construction, then it would be integrally formed with modules 330*b, c* as at least one strip of polymer extending between modules 330*b, c*, (e.g., directly between adjacent edges thereof), thereby coupling the adjacent modules along those adjacent edges. Representative hinges of this configuration are detailed in U.S. Pat. No. 11,358,070, which is herein incorporated by reference in its entirety.

In still other embodiments, the hinges are formed as one or more internal flexible connection strips (e.g., of a thin flexible polymer or textile) extending between adjacent modules and configured to be anchored within internal cavities of adjacent polyhedrons. For example, referring to FIG. 3, if hinge 332*b* had such construction, then one portion of hinge 332*b* would be anchored within an internal cavity of module 330*b*, and another portion of the hinge 332*b* would be anchored with an internal cavity of 332*c*, thereby coupling the adjacent modules along the adjacent corresponding edges. Representative hinges of this configuration are detailed in PCT Publication No. WO 2022/130285.

In any embodiment, more than one hinge may extend between adjacent edges of adjacent modules. The foregoing hinge structures are representative, not limiting.

As an optional feature, each of the modules 330*a-p* may be provided with one or more magnets which are positioned and polarized (e.g., within a cavity of each module) to stabilize the puzzle 300 in different configurations (such as the scaling configurations shown in FIG. 1A-FIG. 2). Representative magnet configurations are detailed below in FIG. 4-FIG. 5D. In some embodiments, each pentahedral module comprises one, two, three, four, or more magnets, each of the magnets being disposed adjacent to a different face of the pentahedral module.

In FIG. 3, each of the modules 330*a-p* is provided with a "+" or "−" to indicate the polarity of the magnet(s) contained therein. For example, modules 330*a, c, e, g, i, k, m, o* are a first type or "Type 1" pentahedral module having a "+" sign indicating that the magnet(s) disposed therein have a first (e.g., positive) polarity. On the other hand, modules 330*b, d, f, h, j, l, n, p* are a second type or "Type 2" pentahedral module which are mirror images of the Type 1 modules and which have a "−" sign indicating that the magnet(s) disposed therein have a different second (e.g., negative) polarity. As the mirror image modules 330*a-p* are connected by the hinges in an alternating sequence, and each sequential pentahedral module has a different polarity, adjacent modules can therefore magnetically couple to each other, thus stabilizing the puzzle 300 in numerous configurations such as those shown in FIG. 1A-FIG. 2.

In FIG. 3, the "+" or "−" signs are placed on faces which may have a magnet positioned adjacent thereto such that a magnetic field from that magnet extends through that face. As shown, the magnets are positioned and polarized within the modules such that hingedly coupled faces of adjacent modules can magnetically couple when positioned adjacent to each other.

Representative structure for positioning magnets is described below with respect to FIG. 5A-FIG. 5D. Additional representative structures for positioning magnets adjacent to faces include those described in U.S. Pat. Nos. 10,569,185 and 10,918,964 and U.S. Patent Publication No. US 2022/0047960, which are hereby incorporated by reference in their entireties.

In FIG. 3, each of the modules 330*a-p* has magnets of a single polarity. However, in other embodiments, at least some modules have magnets of both polarities, particularly if the polarity of each magnet is opposite to the polarity to the magnet of the corresponding face of the hingedly connected module. Accordingly, the arrangement shown in FIG. 3 is representative, not limiting.

Further, although FIG. 3 shows a single "+" or "−" symbol for each module, such symbol may represent more than one magnet, i.e., some embodiments include more than one magnet positioned adjacent to each face, e.g., two or three magnets per face. Such a configuration may increase the magnetic force between adjacent modules. In fact, it is possible for a single face of a single module to have magnets of both polarities, e.g., if each magnet has a polarity opposite to the polarity of a corresponding magnet on the adjacent hingedly connected module.

Figure 4:
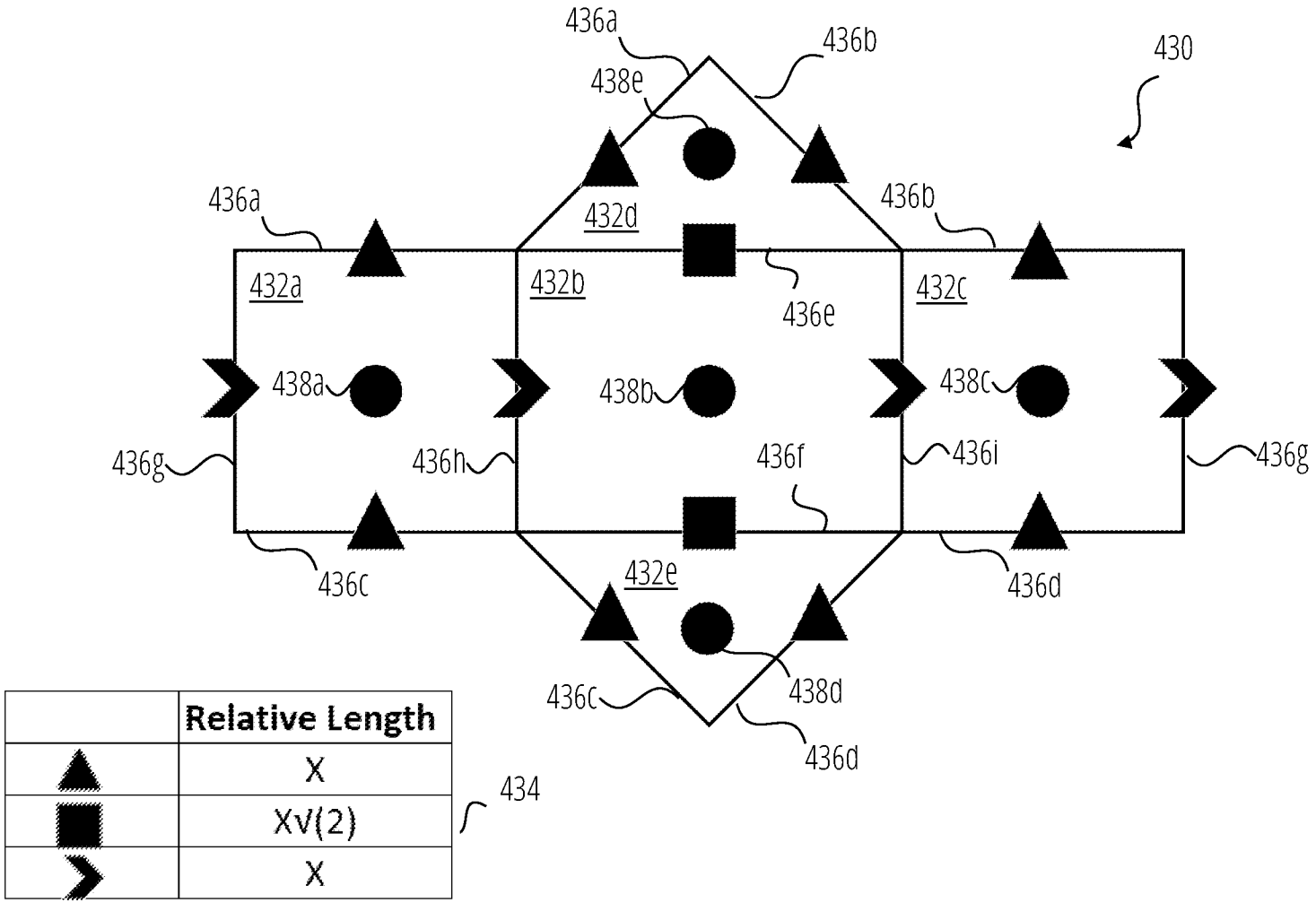
FIG. 4 shows a schematic projection of a pentahedral module of the pentahedral module puzzle of FIG. 3.

FIG. 4 shows a schematic two-dimensional projection of one pentahedral module 430 of the pentahedral module puzzles of FIG. 1A—FIG. 3. The geometry of pentahedral module 430 is identical to every other pentahedral module in said puzzles.

As shown, pentahedral module 430 has five faces 432*a-e* and nine edges 436*a-i*, including three rectangular faces 432*a-c* and two right isosceles triangular faces 432*d-e* disposed on opposite sides of face 432*b*. The nine edges 436*a-i* have two or three edge lengths denoted by legend 434. Specifically, each of the two isosceles triangle faces 432*d*, 432*e* (e.g., right isosceles triangular faces) have two edges with length X and one edge with length X√(2). In FIG. 4, edges 436*a, b, c*, and *d* (indicated by a triangle symbol) have edge length X. Accordingly, edges 436*e, f* have edge length X√(2). In embodiments in which the triangular faces 432*d*, 432*e* are right isosceles triangles, the puzzle can achieve the cube configuration shown in FIG. 2.

In the depicted embodiment, edges 436*g, h, i* (indicated by a chevron symbol) also each have an edge length X (like edges 436*a, b, c*, and *d*). While these three edges generally have the same edge length X, the relative length of edges 436*g, h, i* may not equal the length of edges 436*a, b, c*, and *d* in other embodiments. As one will appreciate, because edge 436*g* has the same edge length as edge 436*h-i*, each of the right isosceles triangle faces 432*d-d* extend perpendicularly from face 432*b* (and parallel to each other).

Comparing FIG. 3 with FIG. 4, it can be seen that the hinges of the puzzle are consistently disposed along two perpendicular edges of each pentahedral module. For example, in an embodiment, the hinges may be disposed along edge 436*b* and edge 436*h*. In another embodiment, the hinges may be disposed along edge 436*d* and edge 436*h*. In another embodiment, the hinges may be disposed along edge 436*a* and edge 436*i*. In still another embodiment, the hinges may be disposed along edge 436*c* and edge 436*i*. Advantageously, this perpendicular hinge placement facilitates manipulation of the puzzle.

As previously mentioned, each pentahedral module 430 may optionally be provided with one or more magnets, e.g., utilizing structure described below in FIG. 5A-FIG. 5D. In FIG. 4, the pentahedral module 430 is provided with five magnets 438*a-e*, representing one or more magnets disposed adjacent to each of the five faces.

In some embodiments, at least some of the magnets are positioned adjacent to faces having a hinge connected thereto (as shown in FIG. 3), such that mirror image faces of hingedly-connected modules magnetically couple. For example, in an embodiment, the pentahedral module 430 comprises magnets 438*a-d*, but not magnet 438*e*. In another embodiment, the pentahedral module 430 comprises magnets 438*a-c* and magnet 438*e*, but not magnet 438*d*.

In some embodiments, at least some of the magnets are positioned and polarized such that mirror image faces of non hingedly-connected polyhedrons magnetically couple when positioned adjacent to each other. For example, referring briefly to FIG. 3, magnets may be provided on inner isosceles faces of modules 330*c* and 330*p* such that those faces magnetically couple together in certain configurations (such as the rhombic prism 202*c* configuration shown in FIG. 2).

Although FIG. 4 shows that each face of pentahedral module 430 has at least one magnet disposed adjacent to that face, the present disclosure contemplates that in some embodiments, some faces of some modules do not comprise any magnets positioned adjacent thereto. Reducing the number of magnets can advantageously reduce manufacturing costs.

Figure 5A:
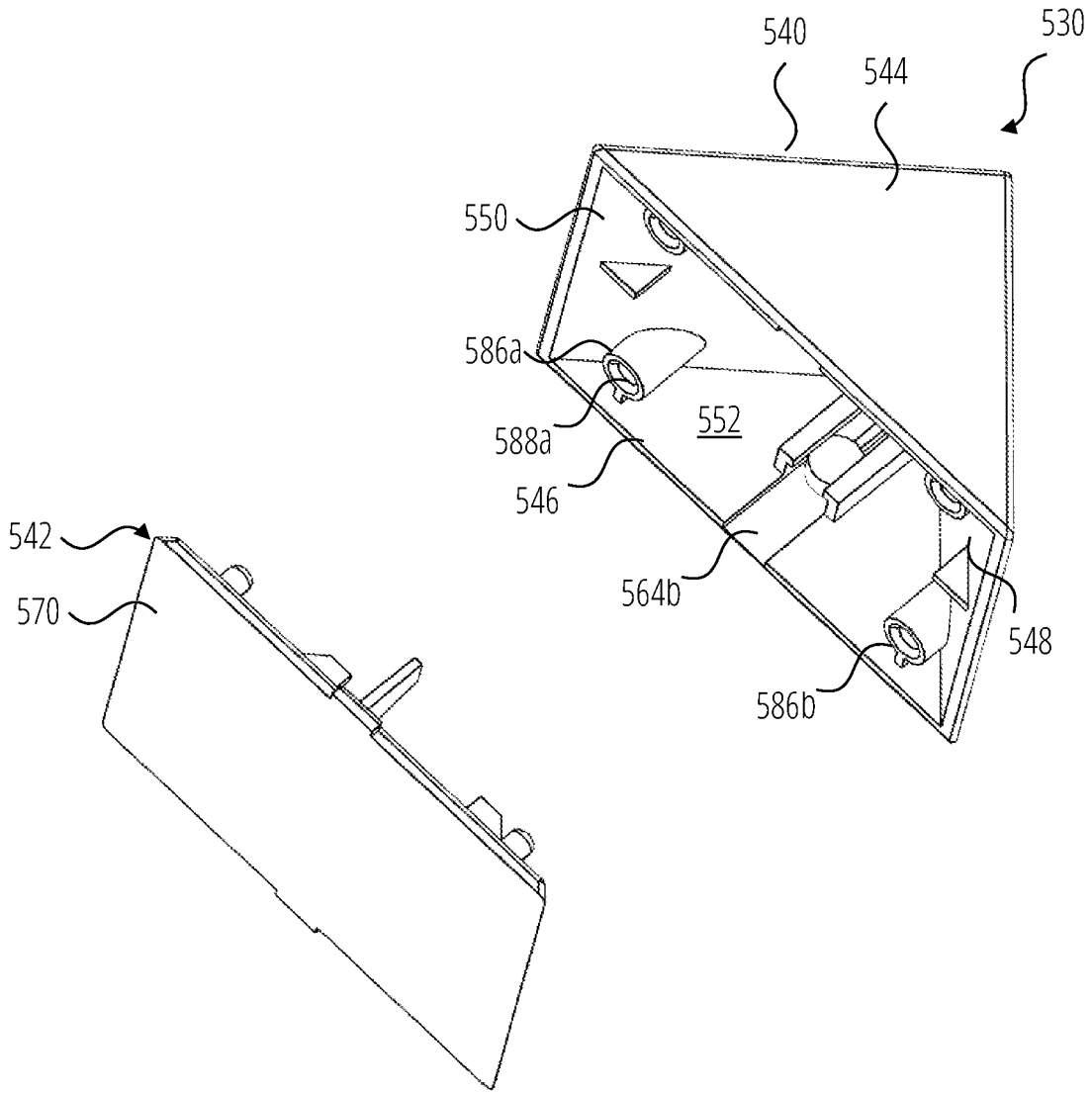
FIG. 5A shows a lower exploded perspective view of one pentahedral module of the puzzle of FIG. 1A.

FIG. 5A shows a pentahedral module 530 corresponding to each of the modules 330*a-p* of FIG. 3 and having the same geometry as shown in FIG. 4. The module 530 includes a shell 540 and a cover 542. The shell 540 may be formed of a molded polymer such as high- and low-density polyethylene (HDPE, LDPE), polypropylene (PP), polystyrene (PS, ABS), polyester (PET), or other suitably durable and safe material.

The shell 540 is an isosceles triangular prism (e.g., a right isosceles triangular prism) having an open end, an upper plate 544, a lower plate 546 and two side plates 548, 550. The upper plate 544 and lower plate 546 are right isosceles triangles with a bottom angle of 45°. The two side plates 548, 550 connect the upper plate 544 and the lower plate 546 to form the opening, and the cover 542 is sized and configured for installation in the opening. Thus, the upper plate 544, lower plate 546 two side plates 548, 550, and the cover 542 can be assembled together to form the module, the plates, covers, and faces of which define a cavity 552 therein. In other embodiments, any of the faces of the module 530 may be the removable cover.

The module 530 is provided with a plurality of magnets therein. The structure for retaining magnets adjacent to each of the side plates 548, 550 will now be described.

In any embodiment, the shell is provided with one or more grooves formed in or on interior surfaces of the cavity, said grooves being at least partially delimited by a stop block and receiving a magnet therein. For example, referring to FIG. 5B, the side plate 548 is provided with a recess or groove 554 formed in an interior surface thereof, and a stop block 556 extends partially around a circumference of the groove 554 in a U-shape.

Figure 5B:
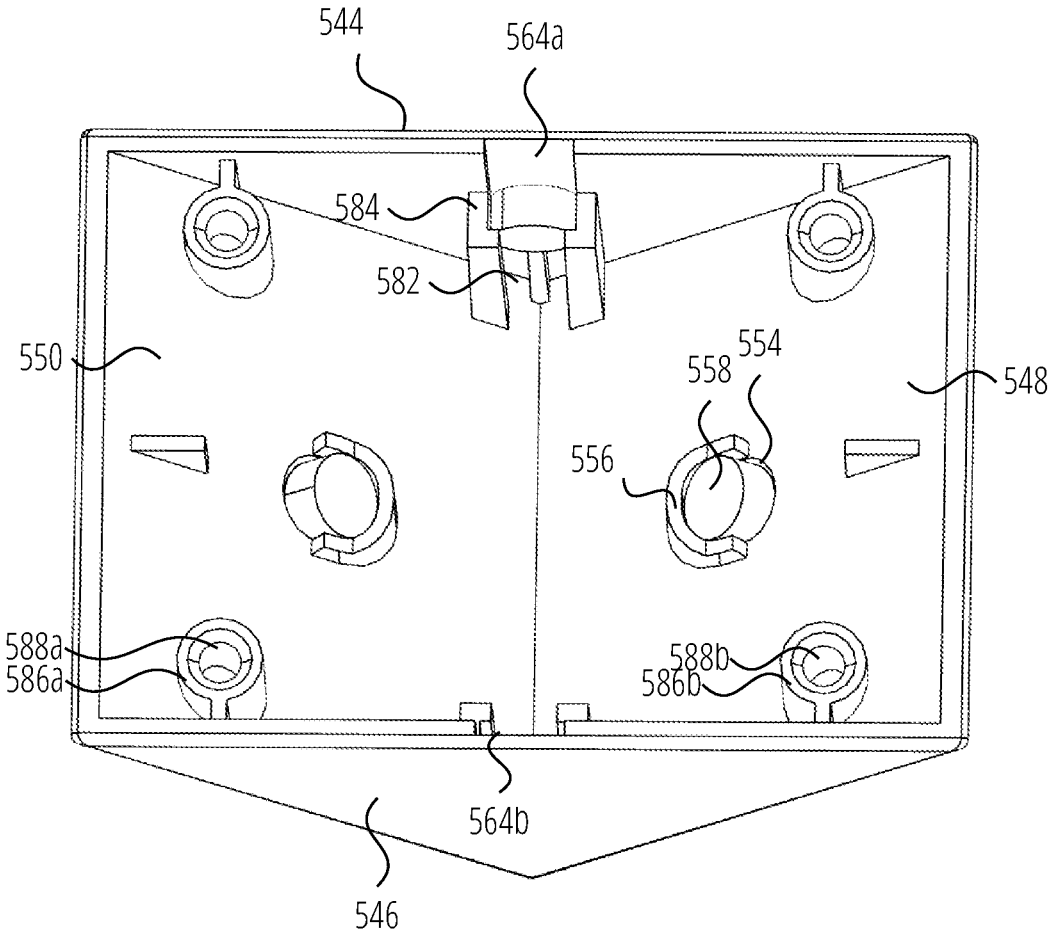
FIG. 5B shows a lower perspective view of a shell of the pentahedral module of FIG. 5A.
Figure 5C:
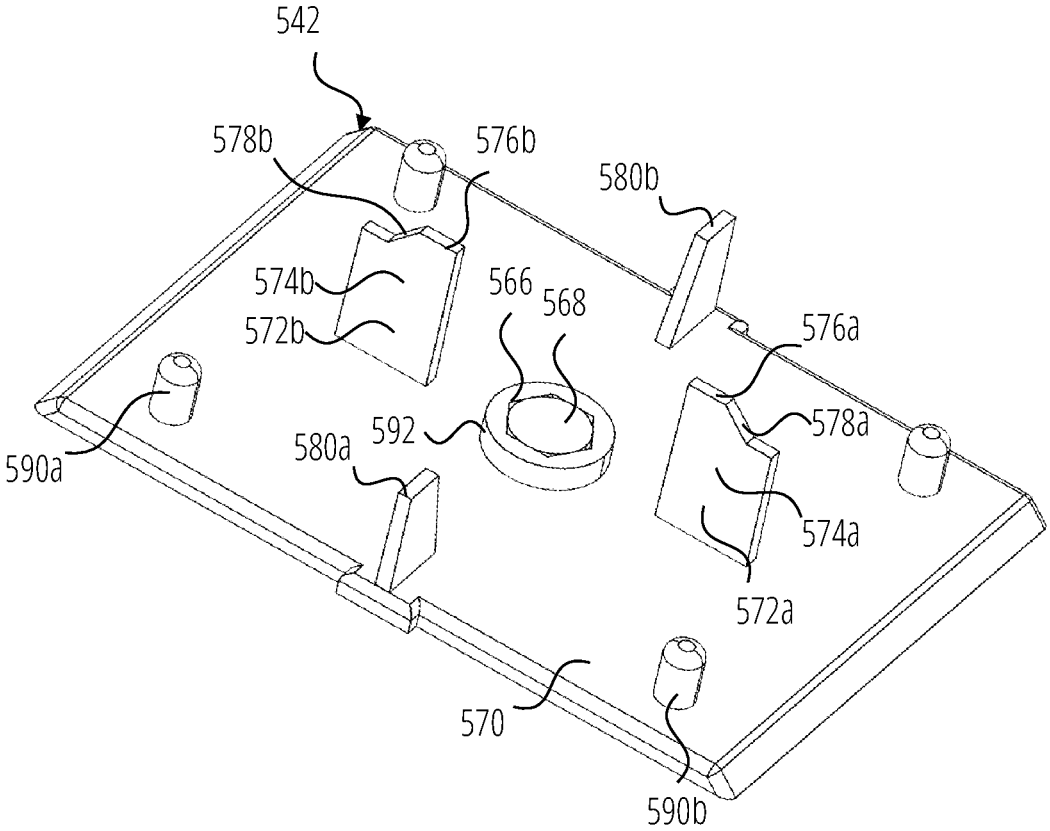
FIG. 5C shows an upper perspective view of a cover of the pentahedral module of FIG. 5A
Figure 5D:
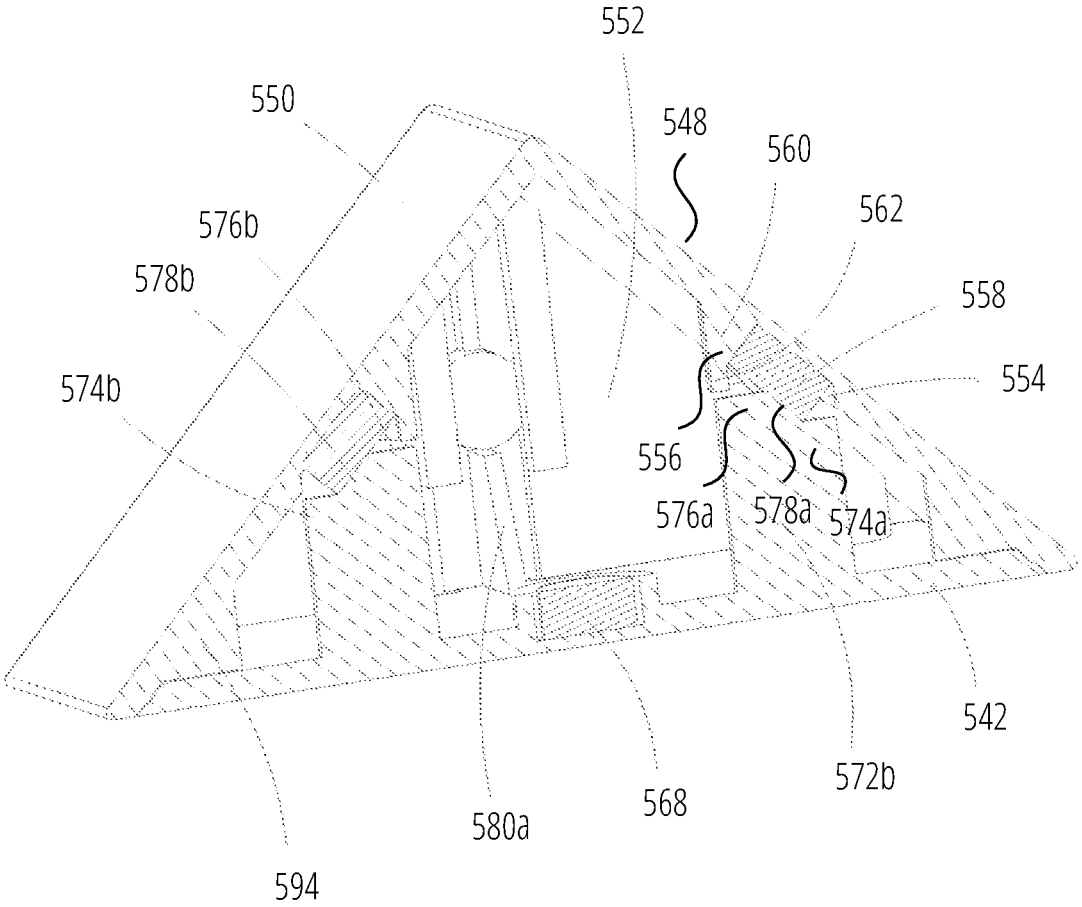
FIG. 5D shows a section view of the pentahedral module of FIG. 5A.

Referring briefly to FIG. 5D, the stop block 556 forms a clamping block 560 configured to limit movement of a magnet 558 within the groove 554. The end of the clamping block 560 extends downward away from stop block 556 to form a limiting block 562, further preventing movement of the magnet 558. Together, the clamping block 560, limiting block 562, and the groove 554 enclose the magnet 558 with the aid of an additional clamping block (described below). The opposite side plate 550 is provided with an alike groove, clamping block, and limiting block, which are together configured to retain a magnet therein.

In any embodiment, the shell of each of the sixteen pentahedral modules comprises clamping block extending away from an interior surface of the cavity, the clamping block having a magnet abutting surface at a distal end thereof, wherein the magnet abutting surface is positioned adjacent to the first magnet. For example, referring to FIG. 5C, the cover 542 is provided with two clamping blocks 572*a*, 572*b* and a third groove 566 sized to receive a magnet 568.

Clamping block 572*a* includes a base 574*a* extending away from an interior surface of the cover plate 570 and a protrusion 576*a* extending upward from the upper end of the base 574*a*. A magnet abutting surface 578*a* (referred to simply as a magnet abutting surface) is provided at a distal end of the clamping block 572*a* between the protrusion 576*a* and the upper end of the base 574*a*. The magnet abutting surface 578*a* is an inclined plane relative to the cover 542. Each magnet abutting surface 578*a*, 578*b* is configured to be positioned adjacent to one of the plurality of grooves of the shell. Similarly, clamping block 572*b* includes a base 574*b*, protrusion 576*b*, and a magnet abutting surface 578*b*.

Each groove (e.g., 554 and 566) is thus equipped (or configured to be equipped) with a magnet positioned adjacent to the corresponding face. For example, referring to FIG. 5D, magnet 558 is positioned and held adjacent to the side plate 548 by the clamping block 560 and limiting block 562. The magnet abutting surface 578*a* abuts the magnet 558, the protrusion 576*a* and the stop block 556 enclose the upper end of the magnet 558, and the base 574*a* and the side wall of the groove 554 enclose the lower end of the magnet 558.

The module 530 of the present disclosure thus forms a first accommodating groove by arranging a clamping block, a limiting block and a groove on the side plate, and the magnet is accommodated therein. Advantageously, this structure facilitates fixing the magnet on the inclined side plate 550 and ensures stability of the magnet 558.

The structure for retaining magnets adjacent to each of the upper plate 544 and lower plate 546 will now be described.

In any embodiment, the shell of each of the sixteen pentahedral modules is provided with a groove formed in or on an interior surface of the cavity, said groove being at least partially delimited by a holding portion extending away from the interior surface and holding a magnet in the groove. Referring back to FIG. 5B, the upper plate 544 has a second receiving groove 564*a* formed therein. Similarly, as shown best in FIG. 5A, the lower plate 546 is provided with a second receiving groove 564*b*. Since the respective second receiving grooves 564*a*, 564*b* of the upper plate 544 and the lower plate 546 have the same structural design, only one such structure will be described in detail here.

As shown best in FIG. 5B, the middle of the upper plate 544 is provided with a card slot 582 and a holding portion 584 extending away from an interior surface of the upper plate 544 provided on both sides thereof. The top ends of the two holding portions 584 (i.e., ends disposed away from the respective interior surface) are respectively bent in the direction of the center line of the upper plate 544. The two holding portions 584 thus surround the second receiving groove 564*a*.

In any embodiment, each of the sixteen pentahedral modules comprises a second clamping block extending away from an interior surface of the cavity, wherein the second clamping block extends into a groove and holds a magnet therein. For example, referring again to FIG. 5C, the cover 542 is provided with two second clamping blocks 580*a*, 580*b*. When the cover 542 is assembled with the shell 540 as shown in FIG. 5D, the positioning posts of the second clamping blocks 580*a*, 580*b* are inserted into the respective groove 564*a*, 564*b* of the lower plate 546 and upper plate 544, thus securing the respective magnets therein.

Advantageously, because the second receiving grooves 564*a*, 564*b* and the second clamping blocks 580*a*, 580*b* are linear and planar, the two clamping blocks and the grooves can better confine and stabilize the magnets. Further, this design facilitates demolding the mold when the shell 540 and cover 542 are made by injection molding.

The structure for affixing the cover 542 to the upper plate 544 will now be described.

Referring to FIG. 5A first, the shell 540 is provided with a plurality of annular fixing portions such as 586*a*, 586*b*, which may be affixed to the upper plate 544, lower plate 546, side plate 548, and/or side plate 550. Each fixing portion 586*a*, 586*b* is provided with a respective fixing groove 588*a*, 588*b* therein.

As shown best in FIG. 5C, cover 542 is provided with a plurality of fixing columns 590*a*, 590*b*, which are complementary to the fixing grooves 588*a*. Accordingly, when the cover 542 and shell 540 are coupled together, each fixing column 590*a* is inserted into the respective fixing groove 588*a*. The fixing columns 590*a* and the fixing grooves 588*a* are preferably a transition fit or an interference fit. In the illustrated embodiment, there are four fixing portions and four corresponding fixing columns; however, there may be greater or fewer in different embodiments.

The structure for retaining a magnet adjacent to the cover 542 will now be described.

Referring to FIG. 5C, a boss 592 is provided in the center of the cover 542, whereby the boss 592 surrounds the groove 566. Restated, the groove 566 is formed in the boss 592. The magnet 568 can be fixed in the groove 566 with a transitional fit, or it can be fixed in other ways, such as by sealing a cover plate to the opening of the groove 566, thereby sealing the magnet 568 in the groove 566.

Referring to FIG. 5D, an outer end of each side plate 548, 550 (i.e., an end disposed towards the cover 542) is provided with a limiting buttress 594, and the outer side of the limiting buttress 594 (i.e., a side facing the opening) abuts the cover 542. The position between the cover 542 and the shell 540 can therefore be restricted and fixed by the limiting buttress 594.

Representative embodiments of the invention can be implemented in many different forms and are not limited to the implementations described herein. On the contrary, the purpose of providing these embodiments is to make the disclosure of the present disclosure more thorough and comprehensive.

It should be noted that when an element is considered to be "connected" to another element, it may be directly connected to the other element or there may be a centered element at the same time. The terms "upper," "lower," "side," "vertical", "horizontal", "left", "right" and similar expressions used herein are for illustrative purposes only.

Unless otherwise defined, all technical and scientific terms used herein have the same meaning as commonly understood by those skilled in the technical field of the present disclosure. The terminology used in the description of the present disclosure herein is only for the purpose of describing specific embodiments and is not intended to limit the present disclosure. The term "and/or" as used herein includes any and all combinations of one or more related listed items.

What is claimed is:

1. A pentahedral module puzzle, comprising:

sixteen pentahedral modules connected in a mirror image alternating sequence by a plurality of hinges in a continuous loop, wherein sequential hinges of the plurality of hinges have a perpendicular orientation, wherein each pentahedral module comprises a plurality of magnets, wherein each of the sixteen pentahedral modules comprises a molded polymeric shell and a molded polymeric cover enclosing a cavity, wherein the cover of each of the sixteen pentahedral modules is affixed with an opening of the shell, enclosing the cavity, wherein a first groove of a first interior surface of the cavity of each of the sixteen pentahedral modules receives a first magnet of the plurality of magnets, wherein the first interior surface of the cavity of each of the sixteen pentahedral modules comprises a stop block extending at least partially around a circumference of the first groove, and wherein the sixteen pentahedral modules are configured to be manipulated into different multiples of geometrically similar shapes.

2. The pentahedral module puzzle of claim 1, wherein each of the sixteen pentahedral modules comprises two isosceles triangle faces.

3. The pentahedral module puzzle of claim 1, wherein each of the sixteen pentahedral modules comprises nine edges, wherein four of the nine edges have an edge length of one unit, wherein two of the nine edges have an edge length of $\sqrt{2}$ units, and wherein a remaining three of the nine edges each have a same edge length.

4. The pentahedral module puzzle of claim 2, wherein for each of the sixteen pentahedral modules, the plurality of magnets comprises four magnets each disposed adjacent to a different face of the pentahedral module.

5. The pentahedral module puzzle of claim 4, wherein at least one magnet of the plurality of magnets of each of the sixteen pentahedral modules has a different polarity from at least one magnet of the plurality of magnets of each adjacent pentahedral module in the alternating sequence.

6. The pentahedral module puzzle of claim 2, wherein the shell of each of the sixteen pentahedral modules comprises:

an upper plate and a lower plate, each of the upper plate and the lower plate defining one of the isosceles triangle faces; and two side plates connecting the upper plate and the lower plate, wherein each of the side plates defines a rectangular face of the pentahedral module extending between the two isosceles triangle faces, wherein the cover of each of the sixteen pentahedral modules defines another rectangular face extending between the two isosceles triangle faces, and wherein the first interior surface of the cavity is formed by one of the side plates of the shell.

7. The pentahedral module puzzle of claim 6, wherein each of the sixteen pentahedral modules comprises a first clamping block extending away from a second interior surface of the cavity, the first clamping block having a magnet abutting surface at a distal end thereof, wherein the magnet abutting surface is positioned adjacent to the first magnet, wherein the second interior surface of the cavity is formed by the cover, and wherein the magnet abutting surface of the first clamping block extends at an inclined angle with respect to the second interior surface.

8. The pentahedral module puzzle of claim 7, wherein each of the sixteen pentahedral modules comprises a second groove of a third interior surface of the cavity, the second groove being at least partially delimited by a holding portion extending away from the third interior surface and holding a second magnet of the plurality of magnets in the second groove, and wherein the third interior surface of the cavity is formed by one of the upper plate or the lower plate of the shell.

9. The pentahedral module puzzle of claim 8, wherein each of the sixteen pentahedral modules comprises a second clamping block extending away from the second interior surface of the cavity, wherein the second clamping block extends into the second groove and holds the second magnet in the second groove.

10. The pentahedral module puzzle of claim 9, wherein each of the sixteen pentahedral modules comprises a third groove of a fourth interior surface of the cavity, the third groove being at least partially delimited by a stop block and receiving a third magnet of the plurality of magnets.

11. The pentahedral module puzzle of claim 10, wherein each of the sixteen pentahedral modules comprises a boss on the second interior surface of the cavity, wherein the boss comprises a fourth groove receiving a fourth magnet of the plurality of magnets.

12. The pentahedral module puzzle of claim 1, wherein the stop block of the first interior surface of the cavity comprises a clamping block and a limiting block extending from the stop block in a direction away from the first interior surface.

13. The pentahedral module puzzle of claim 1, wherein each of the sixteen pentahedral modules comprises a first clamping block extending away from a second interior surface of the cavity and positioned adjacent to the first magnet.

14. The pentahedral module puzzle of claim 13, wherein each of the sixteen pentahedral modules comprises a second groove of a third interior surface of the cavity and holding a second magnet of the plurality of magnets.

15. The pentahedral module puzzle of claim 14, wherein each of the sixteen pentahedral modules comprises a second clamping block extending away from the second interior surface of the cavity and holding the second magnet in the second groove.

16. The pentahedral module puzzle of claim 15, wherein each of the sixteen pentahedral modules comprises a third groove of a fourth interior surface of the cavity and receiving a third magnet of the plurality of magnets.

17. The pentahedral module puzzle of claim 16, wherein each of the sixteen pentahedral modules comprises a boss on the second interior surface of the cavity, wherein the boss comprises a fourth groove receiving a fourth magnet of the plurality of magnets.

18. The pentahedral module puzzle of claim 1, wherein the sixteen pentahedral modules are configured to be manipulated into one rhombic hexahedron, a set of two rhombic hexahedrons, and a set of four rhombic hexahedrons.

19. The pentahedral module puzzle of claim 2, wherein for each of the sixteen pentahedral modules, the two isosceles triangle faces are right isosceles triangles.

20. The pentahedral module puzzle of claim 1, wherein the sixteen pentahedral modules are configured to be manipulated into one isosceles triangular pentahedron, a set of four isosceles triangular pentahedrons, a set of eight isosceles triangular pentahedrons, and a set of sixteen isosceles triangular pentahedrons.

* * * * *